United States Patent [19]

Cote

[11] 3,960,481

[45] June 1, 1976

[54] PROCESS FOR TANNING LEATHER

[75] Inventor: Gerald M. Cote, Holland, Pa.

[73] Assignee: Thermanil Chemical Company, Incorporated, Croyden, Pa.

[22] Filed: Apr. 18, 1975

[21] Appl. No.: 569,247

Related U.S. Application Data

[62] Division of Ser. No. 292,710, Sept. 27, 1972, Pat. No. 3,901,929.

[52] U.S. Cl. ..... 8/94.26; 8/94.27

[51] Int. Cl.[2] ..... C14C 3/08; C14C 3/06

[58] Field of Search ..... 8/94.26, 94.22, 94.27

[56] References Cited

UNITED STATES PATENTS

| | | | |
|---|---|---|---|
| 3,402,071 | 9/1968 | Heyden et al. | 117/141 |
| 3,629,377 | 12/1971 | Schenck et al. | 260/403 |
| 3,826,610 | 7/1974 | Komarek et al. | 8/94.26 |

*Primary Examiner*—John Kight, III

*Attorney, Agent, or Firm*—Seidel, Gonda & Goldhammer

[57] ABSTRACT

A new tanning agent is provided comprising an organic salt of a phosphorated and ethoxylated saturated fatty acid. The tanning agent is prepared by reacting a saturated fatty acid having 12 to 20 carbon atoms with ethylene oxide, posphorating the resulting ethoxylated fatty acid ester with posphoric anhydride, and neutralizing the phosphorated ester with a strong organic base, such as triethanolamine. The tanning agent is preferably dissolved in a water soluble solvent such as dimethyl formamide and may be diluted with water for addition in the wet processing of leather. The new tanning agent may be added to the leather in the tanning wheel either during the initial tanning or during retanning, and is particularly useful in connection with chrome tanned leathers. Such tanning agents increase dye values and improve softness and other properties of the leather. They also permit the reduction or elimination of chrome tanning agents and fat liquors in the retanning stage as well as improving take up of chrome in the tanning and/or retanning.

12 Claims, No Drawings

PROCESS FOR TANNING LEATHER

This application is a division of my copending application Ser. No. 292,710, filed Sept. 27, 1972, entitled "WET PROCESSING OF LEATHER", now U.S. Pat. No. 3,901,929.

BACKGROUND OF THE INVENTION

The present invention relates to improvements in the wet processing of leather. More particularly, the invention is directed to novel tanning agents and methods for making and using the same in the tanning and retanning of leather.

The production of side leather has many variations depending upon the desired end product, characteristics of the hides, regional variations, individual preferences of tanners, and other factors, but generally passes through the following basic sequence;

After salting or brine curing of the raw hides by the meat packing houses, the hides arrive at the hide house of the tannery where they are opened, trimmed, and sorted. The hides then pass to the beam house where they are soaked for up to several days in water to swell the hide and fibers.

The major objective of the beam house is to remove hair, flesh and extraneous proteins and to rehydrate and swell the hide fibers so that they may be properly tanned. The unhairing process may be done by dissolving or burning the hair or more preferably loosening and saving the hair. The latter method involves liming with slaked lime and sodium hydrosulfide.

The fleshed and unhaired hides next pass to the tanyard where the wet processing of the leather is carried out in rotating drums called tanning wheels. The initial wet processing steps usually involve deliming by reacting with an acid salt, bating with enzyme salts, and optionally pickling with an acid. After these initial wet processing steps, the hides then receive their initial tanning with a chrome tanning agent. It will of course be understood that the various wet processing steps indicated above are interspersed with washings and floatings of the leather stock in water, frequently with light acid or alkaline treatments to adjust the pH.

After sorting, splitting and shaving the leather sides to the proper weight and thickness, the leather stock is subjected to a further wet processing step called retanning. Retanning involves the addition of additional chrome tanning agents, vegetable tanning agents and/or resin tanning agents or syntans. In addition, dyes, fat liquors, and any other materials desired in the final leather are added during this final wet processing step of retanning.

After the retanning, the leather sides are dried, conditioned and finished in various manners depending upon the desired end product. A more detailed description of each of the above steps in the production of side leather may be found for example in *The Chemistry And Technology Of Leather*, edited by O'Flaherty, Roddy and Lollar, Volume 3, pages 235–265, Reinhold Publishing Corporation 1962.

The present invention relates to the wet processing steps in the production of side leather, and more particularly to the initial tanning and retanning of chrome tanned leather. These steps take place in rotating drums or tanning wheels having capacities of 900 to 5,000 or more pounds of leather with corresponding amounts of water.

Chromium is used in the tanning of leather since it will form trivalent compounds such as chromium chloride, chromium sulphate, and chromium oxide. The most widely used chrome tannages are those with a chromium sulphate base. The chromium contents of the salt are usually stated in terms of chromium oxide ($Cr_2O_3$), and commercially available chromium salts have about 25 percent chromium oxide. Commercial chromic or chromium sulphate comes in various hydrated forms which include additional water molecules in complex chemical linkages, represented by the general formula $Cr_2(SO_4)_3 \cdot XH_2O$.

The existence of hydroxyl groups from water in the chromium sulphate, referred as the degree of basicity, can range from monobasic to dibasic and tribasic. The tribasic chromium sulphate salt (having three hydroxyl groups in the formula $Cr_2(OH)_3$) is the most effective in tanning and is referred to as having a 33 percent basicity. The tribasic chromium sulphate has a small size molecular structure which is of great importance in chrome tanning since the particle size controls the degree and speed of penetration of the tanning agent. Moreover, the tribasic salt is cationic and has a tremendous affinity for the fiber protein of the leather.

In order to control the reaction of the chrome tanning agent, a masking agent should be present. Commercial chrome tanning compounds are often manufactured by reducing bichromate of soda with an organic compound such as glucose. A fairly large percentage of this glucose remains in the commercial chromium sulphate and acts as a masking agent. Other masking agents may be added during the tanning including salts, such as sodium salts, of formate, acetate or oxalate. These masking agents simply slow up the cationic action of the chromium salt and maintain a minimum particle size, which results in controlled penetration.

The execution of the initial chrome tannage is performed directly after the hides have been soaked, limed, bated, and in some instances pickled. The prepared hides are added to a rotating drum charged with 80 to 100 percent water and 2 to 3 percent common salt. After several minutes of drumming the hides (agitating the hides in the water by rotating the drums), the diluted chrome tanning agent is usually added in an amount calculated at about 2.5 to 3 percent chromium oxide (33 percent basic salt). The drumming then continues for 5 or 6 hours.

The end point of the tanning (i.e., the point at which a sufficient amount of tanning agent has been picked up by the leather) is determined by immersing a sample of the treated hide in boiling water. A properly tanned leather will not curl or perforate after several minutes of boiling. Although a number of adjustments and additional steps are used by various tanneries, the above is a simple method of the initial tanning of leather.

At this point, the leather will have a pH of about 3.4 to 3.7, and is then removed from the drum for aging. At this point the leather is considered in its "blue" state. During the aging, the leather is horsed (i.e., hung on a horse to drain) to allow a proper setting of the chrome. After sorting, splitting the sides to the proper weight and thickness, and shaving to even thickness, the leather is ready for retanning.

After replacing the leather in a drum the leather must be neutralized by adjusting the pH to about 4.5 to 5, such as by the addition of bicarbonate of soda. The general procedure in retanning is then to incorporate additional amounts of chrome into the leather, as well as the addition of various synthetic tanning agents such as the resin types or vegetable or natural tanning agents. Dyes, fat liquors and lubricating oils are also added during the retanning.

Thee overall objective in retanning of leather is to produce a marketable end product in a number of forms to cover a wide market. Important factors to be achieved are the firmness or pliability of the leather, the general appearance and feel of the grain, the general appearance and feel of the flesh side of the suede, and the ability of the side of leather to be transformed into side leather for shoes, pocketbooks, belts, etc., by the use of finishes such as acrylic emulsions, lacquers and dye coatings.

To achieve the above objectives, tanneries have devised various methods of satisfying their needs. It is generally considered in the industry that leather can be softened by high chrome retanning or in the alternative by normal chrome retanning (6–8 percent $Cr_2O_3$ is the standard amount of chrome desired in the leather although amounts from 5–20 percent are not uncommon depending on the tannery) and extensive use of oil fat liquors. The fat liquors generally used are sulphonated sperm oil or synthetic sperm oil, along with or blended with minerals and soap. These oils are either anionic or cationic and will therefore exhaust on leather quite readily. In effect, they act as a filler and lubricate the fibers and are fixed on the fibers when the leather is dried in the standard methods. Also, the use of fat liquors generally tends to increase the tear strength of the leather.

A serious problem in the leather industry in standard procedures for the initial chrome tanning is that as much as 25 to 30 percent of the chrome tannage or tanning agent does not exhaust from the tanning bath onto the hide fibers. As a result, this large amount of chrome tannage is lost on draining the drums after the initial tanning. This loss of tanning agent represents not only a great additional expense in materials, but also presents a serious effluent problem. Thus, chrome waste from tanneries constitutes a serious polluter of rivers and waterways and requires appreciable industry expense to control this pollution.

Accordingly, it would be exceedingly desirable to find a method of insuring complete or nearly complete exhaustion of the chrome into the leather.

In addition, it would be desirable to find a new method of obtaining a soft, strong leather in such a way that chrome tanning agents and/or fat liquors could be greatly reduced or eliminated during the retanning of the leather.

It would also be desirable to find an aqueous tanning agent or auxiliary for the chrome tanning of leather which would increase the dye value of dyes used in leathers, thereby permitting the use of reduced amounts of dye or improved depth of color with the same amounts of dye.

BRIEF SUMMARY OF THE INVENTION

The above and other objects of the art are achieved by the present invention which includes a novel tanning agent and method for making the same which comprises an organic salt of a phosphorated ethoxylated saturated fatty acid ester, the saturated fatty acid having 12 to 20 carbon atoms. The ethoxylated ester is phosphorated with phosphoric anhydride and the salt is formed by neutralizing the phosphorated ester with an organic base.

The present invention also includes an improvement in the process for the chrome tanning of leather in which the above organic salt is added to the leather while it is in the tanning wheel. The novel tanning agents of the present invention may be advantageously added either during the initial tanning or during the retanning or both.

DETAILED DESCRIPTION OF PREFERRED EMBODIMENTS

In order to prepare the novel tanning agents or auxiliaries of the present invention, a saturated fatty acid is selected which has at least 12 carbon atoms. Thus, it was found that such saturated fatty acids will form stable complexes with phosphorous which will not break down the chromium sulphate tannage complex. In general, the corresponding long chain alcohols are not suitable due to their hydrophilic properties. That is, it is desirable to keep the action of the tanning agent or auxiliary as hydrophobic as possible to avoid a wetting action.

The saturated fatty acids are represented by the general formula $CH_3\ (CH_2)n\ COOH$, wherein $n$ is an integer greater than or equal to 10, and is usually an even integer. The most important saturated fatty acids for use in the present invention are those having 12 to 20 carbon atoms ($n$ = 10 to 18), including lauric acid ($C_{12}$), myristic acid ($C_{14}$), palmitic acid ($C_{16}$), stearic acid ($C_{18}$), and arachidic acid ($C_{20}$). Although the following detailed description of the invention and the specific examples at the end of the specification are all in terms of lauric acid, it is to be understood that the present invention encompasses the use of any of the other saturated fatty acids having 12 or more carbon atoms as indicated above, or mixture of these acids.

The first step of the preparation of the tanning agent of the present invention comprises reacting the saturated fatty acid with ethylene oxide to form an ethoxylated ester of the saturated fatty acid. This is a simple reaction which proceeds at room temperature, and reactions of this sort are well known. It is believed that the reaction produces a mixture of the mono ethylene oxide and diethylene oxide esters, which is estimated at about 50 percent mono and 50 percent di ester. The reaction which produces the mono ethylene oxide ester is indicated below:

$$CH_3\ (CH_2)_n\ COOH + H_2C - O - CH_2 \rightarrow CH_3\ (CH_2)_n\ CO_2 - (CH_2)_2 - O_2C\ (CH_2)n\ CH_3 + H_2O$$

The next step is to phosphorate the ethoxylated ester with phosphoric anhydride (phosphorous pentoxide) $P_2O_5$. This is also a simple reaction which is analogous to the phosphorating or sulfonating which takes place in the manufacture of detergents. Thus, one mole of phosphoric anhydride solid may be directly blended with every three moles of the ethoxylated ester simply by stirring the solid into the fluid ester until completely dissolved. The reaction takes place at room temperature and in the case of the monoethoxy ester may be represented by the following equation:

$$3\ CH_3\ (CH_2)_n\ CO_2 - (CH_2)_2 - O_2C\ (CH_2)n\ CH_3 + P_2O_5 \rightarrow PO\ [(CH_2)_{n+1}\ CO_2 - (CH_2)_2 - O_2\ C\ (CH_2)_{n+1}]_3\ PO + 3H_2O$$

The resulting phosphorated product is a liquid having a pH of about 2.5 to 2.8, and is water insoluble.

Next, the phosphorated ester is neutralized with an organic base, and preferably a strong organic base. While triethanolamine ($(HOCH_2CH_2)_3N$ or TEA) is preferred, diethanolamine, morpholine and other substitutes will be obvious to one of ordinary skill in the art. Although weaker bases could also be used, they would obviously require much greater amounts. Metallic bases, such as sodium hydroxide, should be avoided due to adverse effects of the metals on the leather. The ester should be neutralized to a pH of about 6 ot 7.5, and preferably about 7.0 to 7.2, which in the case of TEA will require about one mole TEA for every four moles of phosphorated ester. Although the remainder of the specification and examples will refer to the TEA salt, it will be understood that other organic salts are included, depending on the organic base used in neutralization as described above.

The ethoxylated ester prior to neutralization with the organic base is highly hydrophobic and water insoluble. The neutralization yields a salt which is somewhat more hydrophilic, but which is still only soluble in water to an extent of about 20 percent. The lower the amount of the organic base in the salt, the lower the solubility in water. Since the wet processing of leather takes place in aqueous baths, it is necessary to render the salt readily soluble in water.

It has been found that the triethanolamine salt in particular is readily soluble in a number of water soluble solvents including dimethyl formamide and dioxane. For introduction of the tanning agent of the present invention into the tanning and retanning cycles, it is preferred to form a 50 percent solution of the triethanolamine salt in dimethyl formamide and then to dilute the resulting solution 50 percent with water to yield a 25 percent solution of the salt. In addition to improving water solubility, the addition of dimethyl formamide makes an excellent adjunct to the wet processing of leather.

Without the 50 percent dilution with water the triethanolamine salt in dimethyl formamide solution is an extremely potent tanning agent. The 50 percent dilution with water serves primarily as a safety factor and economy measure. It has been found that the 25 percent solution of triethanolamine salt in dimethyl formamide and water solution is quite reactive as a tanning agent and softening agent. It is also particularly advantageous as an auxiliary in the presence of chrome and other syntans such as maleic, phenolic, and urea-formaldehyde resin types.

According to the improved tanning methods of the present invention, the above described tanning agent may be added to the leather in the tanning wheel during the initial tanning in an amount, exclusive of the dimethyl formamide and water solvents, of about 0.5 to 2 weight percent, and preferably about 0.75 to 1.25 weight percent, based on the limed weight (i.e., the wet weight after liming) of the leather. The novel tanning agent may be added either alone or as an additional product along with the regular masking agent, and is preferably added after the introduction of the chrome tanning agents to the tanning wheel bath.

After the chrome tanning, the pH will generally be in the vicinity of about 2.5 l to 3.25. Since the triethanolamine salt will precipitate in acids much below a pH of about 3, it is preferred that the initial tanning bath be maintained at a pH in this vicinity during the long drumming period (about 5 to 6 hours). Under these conditions, the novel tanning agent can be added effectively over a period of about 1 hour, ending at a pH of about 3.5 to 3.8. At this point most tanneries desire to keep the pH of the leather at about this level. However, if a higher pH is necessary or desired, this can be increased by adding sodium bicarbonate and drumming for 15–20 minutes.

Moreover, at the above indicated pH the novel tanning agent will not precipitate the chromium sulphate but will increase the penetrating value of the chrome and initiate an almost complete exhaust of the chrome into the leather. Although applicant does not wish to be bound by any particular theory, it is believed that a cross linking takes place between the chrome and phosphorated salt. This does not result in the solubilization of the chrome but cross links with the fibers of the leather. This is desirable since the whole object of tanning is the picking up of desired salts from the bath by the leather.

The complete or almost complete exhaustion of the chrome onto the leather solves the serious effluent problem mentioned previously. As a result, the amounts of chrome added during the initial tanning process could be cut by at least 25 percent. Alternatively, the same amounts of chrome could be used so that additional chrome would be present in the leather. The latter alternative would be particularly effective in allowing the elimination of additional chrome in the retanning process.

Where the novel tanning agents of the present invention have been incorporated during the initial tanning, the tanned leather is aged and horsed in the usual manner, except that precautions must be taken to prevent the leather from drying out too rapidly. Thus, the triethanolamine salt is still quite hydrophobic and repels water more rapidly so that the leather will tend to dry out faster than usual. The neutralization of the leather prior to retanning may proceed as usual.

When used in the initial tanning the products of the present invention have only a limited amount of softening action on the leather and are primarily used to improve the penetration of the chrome. However, when used in the retanning process they have a potent effect as both tanning and softening agents. as a result, the fat liquors or other lubricating oils generally used to soften the leather during the retanning can be substantially reduced or completely eliminated.

The tanning agents of the present invention may be added to the leather in the tanning wheel in the same form as they are added in the initial tanning in an amount, exclusive of the dimethyl formamide and water solvents, of about 0.5 to 2 and preferably about 1.0 to 1.5 weight percent, based on the blue weight (i.e., wet weight after initial tanning) of the leather. The pH of about 7 of the triethanolamine salt will enable it to remain stable in the usual chrome retanning bath. Where additional chrome tanning agents are used in the retanning bath, it is preferred that the tanning agents of the present invention be added after the addition of the chrome tanning agents. However, as indicated previously, the use of the tanning agents of the present invention permits the complete deletion of chrome tanning agents from the retanning process.

It is believed that even further complexing and cross linking of the products of the present inventiion with the chrome tannage in the leather is responsible for the exceptional softening effect on the fibers. As a result, the salts of the present invention may be used with or without the use of fat liquors and lubricating oils, depending upon the amount of the salt used.

The saving in fat liquors and lubricating oils when the products of the present invention are used is substantial, since only about 0.5 to 2 percent, and preferably about 1.5 percent of active ingredients of the tanning agents of the present invention are required compared to about 12–15 percent oils, based upon the blue weight of the leather.

Finally, the use of the tanning agents of the present invention in the retanning process results in a significant increase in the dye value of dyes used to color the leather during the retanning. Although the organic salt may be added either before or after the dye stuff has been exhausted onto the leather, it is preferred that the salt be added prior to the addition of the dye in order to obtain the greatest increase in dye value. Moreover, further increases in dye value are achieved when the lubricating oil or fat liquor is reduced.

It is believed that the improvement in dye value, particularly with acid type dyes, is due to an ability of the products of the present invention to keep the dye aggregate size high and soluble. As a result of the solubility there is better penetration of the dye, and greater color is achieved when the dye aggregate is not reduced in size.

The novel tanning agents and improved methods of the present invention will now be described in further detail with reference to the following specific, nonlimiting examples. In the examples, all percentages are weight percentages based on the wet weigth (limed weight in Ex. I and blue weight in Exs. II, III and IV) of the leather, unless otherwise indicated.

EXAMPLE I

This example illustrates the use of the products of the present invention in the initial tanning of leather. Raw hides received from the beam house, which have been limed, are loaded into drums of various sizes with capacities as high as 20,000 pounds of hides based on the weight of the limed hides which have a pH of about 8–9. After loading the drums, the drums are charged with 80–100 percent water to float the hides. At this point the hides are delimed and bated, maintaining the above pH and are then washed. The hides are again floated with 80–100% of water and 3% sodium chloride is then added and the drums are rotated for 30 minutes at about 70°F. Next, 0.4 to 0.6% of sulfuric acid is added or sufficient amount to bring the hide pH from 1.5 to 3. This may take from 1 to 10 hours. Next, 10–12% of chromium sulphate solution, corresponding to the amount of 2.5–3% chromium oxide (33% basic) is added in four portions at 1 hour intervals during the total of the 6 hour run or longer (rotation of the drums) at 70°F., the period of time for tanning being sufficient to allow complete penetration of the chrome so that the leather has the ability to pass the boil test. After this chrome tanning, the pH is about 2.5–3.25.

A tanning agent according to the present invention is made by phosphorating ethoxylated lauric acid ester with phosphoric anhydride as described above, and neutralizing the phosphorated ester to a pH of about 7.0–7.2. The resulting triethanolamine salt is dissolved in an equal weight of dimethyl formamide and diluted with water to yield an additive having 25 percent active ingredient as described above. With the hides still in the drums at a pH of about 2.5–3.25, about 3–5 percent (based on the limed weight of the hides) of the above prepared additive (0.75–1.25 percent active ingredient) is added to the drum and drummed for 1 hour. By the method of this example the chrome is almost completely exhausted onto the leather, and only a limited amount of washing is necessary. The leather is then removed from the drum and considered in the blue state and ready for retanning.

The following examples illustrate the use of the tanning agents according to the present invention in the retanning of the leather:

EXAMPLE II

A batch of 1,000 pounds shaved weight blue sides (intended for use as shoe glove leather) having a standard chrome content from the initial tanning was charged to a drum for retanning. The leather was first washed with water for 10 minutes at 120°F. and then floated at the same temperature. Next, the following reactants were added: 50 pounds chromium sulphate (in dry form), followed by a run of 45 minutes at 90°F.; 4 pounds of sodium formate (in dry form), followed by a run of 50 minutes at the same temperature; and 10 pounds of bicarbonate of soda (in dry form), followed by a run of 30 minutes also at 90°F. The treated leather was then washed for 30 minutes at 90°F. and floated at 110°F. Next were added 20 pounds each of quebracho extract (a vegetable tanning agent from wood tannin), Extract 181 (a vegetable tanning agent produced by Rohm & Haas Co.), and Orotan LF-38 ( a synthetic phenol formaldehyde type tanning agent sold by Rohm & Haas.), and the drum was then run for 30 minutes at 110°F.

The same diluted tanning agent as used in Example I was prepared and added to the drum in an amount of about 40 pounds (10 pounds active ingredients), and the drum was run for 15 minutes at 110°F. The leather was then dryed dry (i.e., dye added in dry state and not predissolved) with one pound of Calcofast Brown FN (AATCC Color Index: Acid Brown 96) and ½ pound Calcofast Olive Brown G (Color Index: Acid Brown 98), both made by American Cyanamid Co. The drum was then run for 20 minutes at 110°F., followed by the addition of 20 ounces of 85 percent formic acid to set the dye and a run of 10 minutes at 110°F. The leather was then washed for 10 minutes at 125°F. and floated at the same temperature. Finally, a fat liquor comprising 20 pounds of Texol $SO_4$ (a sulphonated codfish oil made by Eastern Oil and Chemical Company), and topping oils comprising 5 pounds of $CA_4O$ UN $SO_4$ (a sulphonated mineral oil made by Eastern Oil and Chemical Company), and 5 pounds of LIP SO $SO_4$ (a sulphonated mineral oil made by BASF Corporation) were added to the leather in the drum, and the drum was run for 15 minutes at 125°F.

After removing from the drum and drying, the resulting leather had excellent softness and strength and better than usual dye color. This is considered a relatively oil free leather since fat liquor was mostly water and was only added to give oil texture. The total oil content of the resulting leather was only about 1–2% compared to the usual 12–15%.

EXAMPLE III

A batch of 1,000 pounds shaved weight in the blue sides (intended for use as black shoe lining leather) was charged to a drum for retanning. The leather sides were washed and floated as in Example II, but no chromium tanning agents were added. Immediately after the washing and floating was added 50 pounds (12.5 pounds active ingredients) of the same tanning agent of the present invention as used in Examples I and II. The drum was then run for 20 minutes at 90°F., followed by the addition of 20 pounds of Orotan LF-38, and another run of 10 minutes at 110°F. Next was added in dry form 30 pounds of penetrating black dye (a blend of several dyes consisting primarily of Calcoid Black 10B (Acid Black 1, C.I. No. 20470) and Calcocid Orange Y (Acid Orange 7, C.I. No. 15510), both made by American Cyanamid Co., plus about 10% of several toning dyes), followed by a run of 20 minutes at 110°F., the addition of 20 ounces of 85 percent formic acid to set the dye, and another run of 10 minutes at 110°F. The leather sides were next washed for 10 minutes in water and floated at 125°F. Finally, after the addition of a fat liquor comprising 20 pounds of Texol $SO_4$ and a run of 15 minutes at 125°F., the leather was pulled from the drum.

The resulting leather had extremely good dye color as well as excellent softness and strength. This was also considered a relatively oil free leather.

EXAMPLE IV

A batch of 1,000 pounds shaved weight in the blue sides (intended as oil-free softy leather) was charged to the drum for retanning. The retanning was carried out exactly the same as in Example II through the wash and float after dyeing, except that the quebracho extract and Extract 181 were deleted and the drum was run for only 10 minutes after the addition of Orotan LF-38. However, 60 pounds of the same diluted tanning agent of the present invention as used in Example I was added instead of 40 pounds as in Example II. After the dry dyeing with the same dye as Example II, setting with formic acid and wash and float as in Example II, 20 ounces of top oil were added and the drum was run for 10 minutes at 125°F. No fat liquor or additional topping oils were added, and the leather was then pulled from the drum.

Despite the deletion of the fat liquor and top oil, the pulled leather still had excellent softness and strength as well as improved dye color as in the previous examples.

The present invention may be embodied in other specific forms without departing from the spirit or essential attributes thereof and, accordingly, reference should be made to the appended claims, rather than to the foregoing specification as indicating the scope of the invention.

I claim:

1. In a process for the chrome tanning of leather the improvement comprising adding to the leather while it is in the tanning wheel a tanning agent comprising an organic salt of a phosphorated ethoxylated saturated fatty acid ester, the saturated fatty acid having from 12 to 20 carbon atoms and said salt being the neutralization product of said ester with an organic base.

2. A process according to claim 1 wherein the tanning agent of is first dissolved in a water soluble solvent.

3. A process according to claim 2 wherein said solvent is dimethyl formamide.

4. A process according to claim 3 wherein the dissolved tanning agent is diluted with water to yield an additive comprising about 25% tanning agent, 25% dimethyl formamide and 50% water.

5. A method according to claim 1 wherein said tanning agent is added to the leather in the tanning wheel during the initial tanning of the leather.

6. A method according to claim 5 wherein said tanning agent is introduced to the tanning wheel after the addition of chrome tanning agents.

7. A method according to claim 6 wherein said tanning agent is added in an amount exclusive of solvents of about 0.5 to 2 weight percent based on the dry weight of the leather.

8. A method according to claim 1 wherein said tanning agent is added to the leather in the tanning wheel during the retanning of the leather.

9. A method according to claim 8 wherein said tanning agent is introduced to the tanning wheel after the addition of chrome tanning agents and before the dry dyeing of the leather.

10. A method according to claim 8 wherein no chrome tanning agents are used during the retanning of the leather.

11. A method according to claim 8 wherein no fat liquor is added to the leather during the retanning.

12. A method according to claim 8 wherein said tanning agent is added in an amount exclusive of solvents of about 0.5 to 2 weight percent based on the dry weight of the leather.

* * * * *